US006910854B2

(12) United States Patent
Joslin

(10) Patent No.: US 6,910,854 B2
(45) Date of Patent: Jun. 28, 2005

(54) LEAK RESISTANT VANE CLUSTER

(75) Inventor: Frederick R. Joslin, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 86 days.

(21) Appl. No.: 10/266,649

(22) Filed: Oct. 8, 2002

(65) Prior Publication Data

US 2004/0067131 A1 Apr. 8, 2004

(51) Int. Cl.[7] ..... F01D 1/09

(52) U.S. Cl. ..... 415/139; 415/191; 415/210.1

(58) Field of Search ..... 415/139, 191, 415/210.1, 115, 116, 110, 134–5, 175; 416/95, 97 R, 97 A

(56) References Cited

U.S. PATENT DOCUMENTS

| | | | | | |
|---|---|---|---|---|---|
| 1,423,466 | A | | 7/1922 | Snyder | |
| 3,231,285 | A | | 1/1966 | Weltmer et al. | 277/53 |
| 3,572,728 | A | | 3/1971 | Smuland | 277/57 |
| 3,728,041 | A | | 4/1973 | Bertelson | 415/189 |
| 3,752,598 | A | * | 8/1973 | Bowers et al. | |
| 3,970,318 | A | | 7/1976 | Tuley | 277/26 |
| 3,981,609 | A | * | 9/1976 | Koenig | |
| 3,995,971 | A | * | 12/1976 | White | 415/160 |
| 4,422,827 | A | | 12/1983 | Buxe et al. | 416/193 |
| 4,623,298 | A | * | 11/1986 | Hallinger et al. | 415/139 |
| 4,650,394 | A | * | 3/1987 | Weidner | 415/115 |
| 4,976,444 | A | | 12/1990 | Richards | 277/53 |
| 5,088,888 | A | | 2/1992 | Bobo | 415/170.1 |
| 5,167,485 | A | | 12/1992 | Starkweather | 415/115 |
| 5,244,216 | A | | 9/1993 | Rhode | 277/53 |
| 5,290,144 | A | | 3/1994 | Kreitmeier | 415/173.1 |
| 5,374,161 | A | * | 12/1994 | Kelch et al. | 415/139 |
| 5,639,095 | A | * | 6/1997 | Rhode | 277/1 |
| 6,164,655 | A | | 12/2000 | Bothien et al. | 277/303 |
| 6,261,053 | B1 | * | 7/2001 | Anderson et al. | 415/115 |
| 6,270,311 | B1 | * | 8/2001 | Kuwabara et al. | 415/110 |
| 6,276,692 | B1 | * | 8/2001 | Beeck et al. | 277/411 |
| 6,290,459 | B1 | | 9/2001 | Correia | 415/139 |
| 6,339,879 | B1 | * | 1/2002 | Wheat et al. | 29/889.721 |
| 6,425,738 | B1 | | 7/2002 | Shaw | 415/208.1 |
| 6,439,844 | B1 | * | 8/2002 | Turnquist et al. | 415/173.3 |
| 2002/0071764 | A1 | | 6/2002 | Turnquist et al. | 415/173.3 |

FOREIGN PATENT DOCUMENTS

| | | |
|---|---|---|
| FR | 1.330.656 | 5/1963 |
| GB | 532372 | 1/1941 |
| JP | 55023320 | 2/1980 |
| JP | 09133003 | 5/1997 |

* cited by examiner

*Primary Examiner*—Edward K. Look
*Assistant Examiner*—Igor Kershteyn
(74) *Attorney, Agent, or Firm*—Kenneth C. Baran

(57) ABSTRACT

A vane cluster for a turbine engine compressor or turbine includes a shroud 12 with a nonlinear slot 26 extending therethrough to divide the shroud into thermally independent shroud segments 24. The slot is bordered by matching nonlinear surfaces 28 that are easy and inexpensive to produce with conventional wire EDM equipment. The nonlinear profile of the slots effectively resists fluid leakage.

13 Claims, 2 Drawing Sheets

LEAK RESISTANT VANE CLUSTER

TECHNICAL FIELD

This invention relates to shrouded vane clusters of the type used in turbine engines, and particularly to a cluster with a leak resistant, segmented shroud.

BACKGROUND OF THE INVENTION

The compressor section of a typical gas turbine engine comprises a case circumscribing an engine axis and axially alternating arrays of stationary vanes and rotatable blades. Each vane array may be constructed of multiple vane clusters distributed circumferentially about the interior of the case with each cluster being supported by the case. Each vane cluster comprises a radially inner shroud, a radially outer shroud, and two or more airfoils extending between the shrouds. Collectively, the inner and outer shrouds define the inner and outer boundaries of part of an annular flowpath for a working medium fluid.

During engine operation, the vane clusters are subject to nonuniform heating and cooling. The accompanying temperature gradients can cause damage by overstressing the clusters. To help alleviate these thermally induced stresses, one of the two shrouds may be divided into segments by slots that sever the shroud at locations circumferentially intermediate two neighboring airfoils. Since the outer shroud of each cluster connects the cluster to the case, it is conventional to segment the inner shroud rather than the outer shroud. The slots reduce the risk of damage by allowing the shroud segments to expand and contract independently of each other.

One technique for forming the slots is wire electro-discharge machining (EDM). Wire EDM uses an electrically charged electrode in the form a wire wound around a source spool and extending to a take-up spool. The vane cluster shroud is exposed to the wire between the spools. During the EDM operation, the wire travels from the source spool to the takeup spool and simultaneously advances toward the shroud. The difference in electrical charge between the wire electrode and the shroud causes an electrical discharge that removes material from the shroud. As material is removed, the wire advances through the shroud until the slot is completely formed.

One drawback of the shroud slots is that they provide a path by which working medium fluid can leak out of the flowpath during engine operation or by which non-working medium fluid can leak into the flowpath. Leakage can be mitigated, to some extent, by using a small diameter EDM wire to cut a thin slot, i.e. one with a correspondingly narrow kerf. However the use of thin EDM wire leads to increased machining time. Moreover, thin EDM wire is more susceptible to breakage than thick EDM wire during the EDM operation. Thin EDM wire is also more likely than thick EDM wire to be stalled by the presence of minute particulate impurities trapped in the vane cluster. Finally, commercially available EDM equipment capable of using thin wire is more specialized than EDM equipment capable using thicker wire. As a result, a manufacturer may find it economically unattractive to invest in the more specialized, thin wire equipment. Accordingly, it may be desirable to avoid thin slots in favor of relatively wider slots One way to reduce leakage through a wide slot is to provide a recess in the interior of the slot and install a seal in the recess. U.S. Pat. Nos. 3,728,041, 3,970,318, and 5,167,485 show arrangements of this type. Although such seals may be easily installable between the shrouds of individual vanes, or between the circumferential extremities of adjacent vane clusters, they are not easily installable in the inter-airfoil shroud slots of an otherwise unitary vane cluster. In addition, forming the intra-slot recess increases manufacturing cost and decreases manufacturing throughput. Another possible way to mitigate leakage is to install an external seal, such as the sealing strip 78 shown in U.S. Pat. No. 4,422,827, to bridge across each slot. However such external seals also increase manufacturing cost.

What is needed is a vane cluster with thermally independent shroud segments and which is economical and easy to manufacture.

SUMMARY OF THE INVENTION

According to the invention, a vane cluster includes a shroud with a nonlinear slot extending therethrough to divide the shroud into thermally independent shroud segments. The slot is bordered by matching nonlinear surfaces that are easy and inexpensive to produce with conventional wire EDM equipment. The nonlinear slots effectively resist fluid leakage.

BEST MODE FOR CARRYING OUT THE INVENTION

Figure 1:
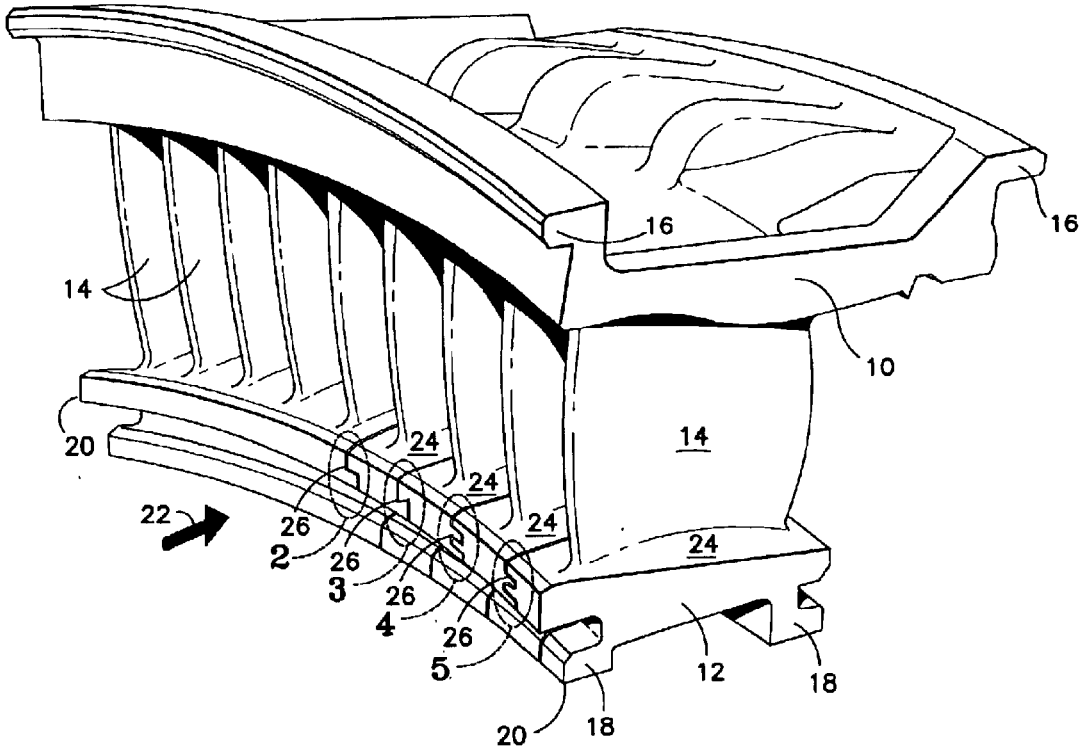
FIG. 1 is a perspective view of a vane cluster whose radially inner shroud is segmented by slots embraced by the present invention.

Referring to FIGS. 1–5, a vane cluster for a turbine engine compressor includes a radially outer shroud 10, a radially inner shroud 12 and two or more airfoils 14 extending radially or spanwisely between the shrouds. Hooks 16 at the axial extremities of the outer shroud facilitate its attachment to an engine case, not shown. Feet 18 at the axial extremities of the inner shroud accommodate an inner airseal, also not shown. The cluster extends circumferentially between lateral extremities 20. When several such clusters are installed in a turbine engine, the shrouds define the radially inner and outer boundaries of a portion of an annular fluid flowpath 22. The flowpath circumscribes an engine axis, not shown. The vane cluster itself is typically a cast metallic article finish machined to prescribed dimensions.

The inner shroud 12 is divided into individual segments 24 by nonlinear slots 26 between circumferentially neighboring airfoils 14. The slots are installed by wire EDM or other suitable process. Four different types of slots are depicted in FIG. 1, however only one type of slot would ordinarily be used in a given cluster. The leftmost portion of the inner shroud is depicted in its "as-cast" state, i.e. without slots. Each slot is nonlinear, but may comprise two or more straight line portions as seen best in FIGS. 2–4. Each slot is bordered by a pair of matching surfaces, such as 28*a*, 28*b*. As used herein, the term "matching" surfaces refers to surfaces that are substantially exact counterparts of each other, i.e. surfaces that complement each other. This is in contrast to the surfaces shown in U.S. Pat. Nos. 3,728,041, 3,970,318, and 5,167,485, all of which feature intra-slot recesses that render the adjacent slot surfaces non-matching.

Figure 2:
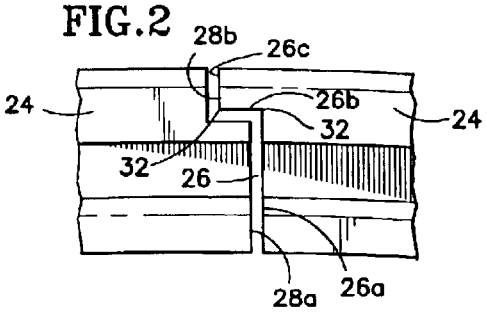
FIGS. 2–5 are enlarged views of the slots shown in FIG. 1.
Figure 5:
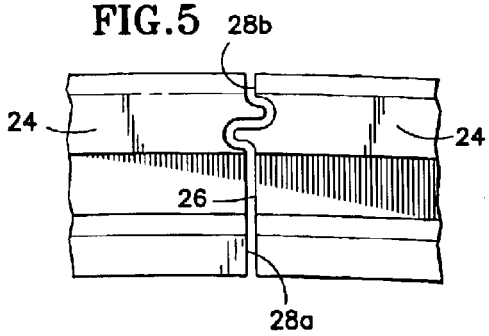

FIGS. 2–5 show the four slots in greater detail. Referring first to FIG. 2, the nonlinear slot 26 comprises three straight line portions 26*a*, 26*b*, 26*c*, each of which has a juncture 32 with at least one of the other portions. Each juncture corresponds to a change of angular direction in the slot. For example, one juncture 32 between slot portions 26*a* and 26*b* corresponds to an approximate 90 degree change of angular orientation from the radial direction to the lateral direction. The other juncture 32 between slot portions 26*b* and 26*c* corresponds to another change of approximately 90 degrees from lateral to radial. The accumulated angular change is therefore about 180 degrees.

Figure 3:
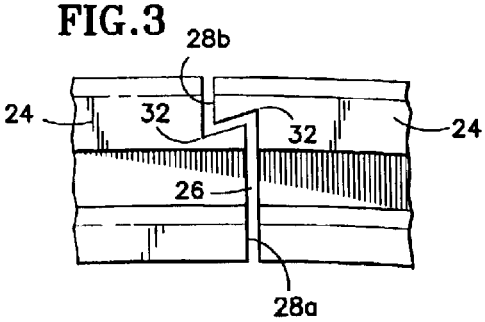

FIG. 3 shows a variant in which the slot comprises three straight line portions and two junctures. Each juncture corresponds to an approximately 120 degree change of angular orientation for an accumulated angular change of about 240 degrees.

Figure 4:
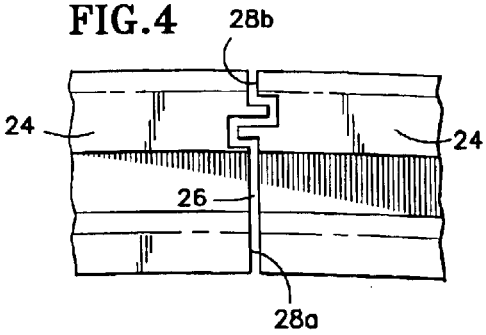

FIG. 4 shows a variant in which the slot comprises seven straight line portions and six junctures. Each juncture corresponds to an approximately 90 degree change of angular orientation for an accumulated angular change of about 540 degrees.

The abrupt changes in angular orientation at the junctures 32 help resist fluid leakage through the slot and therefore permit the use of inexpensively installed, relatively wide slots that might otherwise be unsatisfactory. Each change of orientation increases the resistance to fluid leakage. As a result, larger and/or more abrupt changes are superior to smaller and/or less abrupt changes. Accordingly, although a slot having only two straight line portions and one juncture can be used, it is believed that the most practical and cost effective slots are those with at least three straight line portions and two changes of orientation totaling at least about 180 degrees. A larger quantity of straight line portions would be expected to further increase leak resistance of the slot, but the correspondingly longer slot length would increase the time necessary to cut the slot using wire EDM. The tradeoff between leak resistance and manufacturing complexity is a matter for consideration by the designers and manufacturers of the vane cluster.

Figure 6:
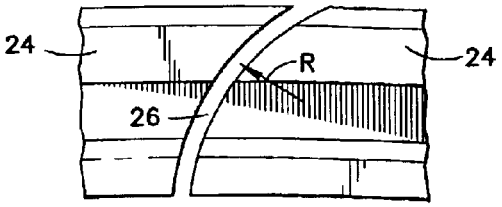
FIGS. 6–8 are enlarged views of slots having curved portions.
Figure 7:
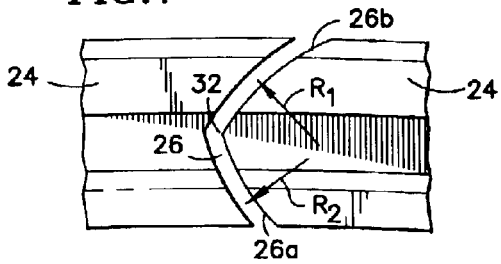
Figure 8:
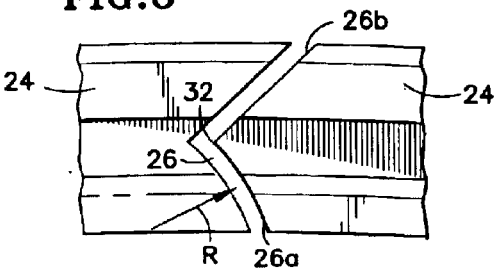

As seen in FIGS. 6–8, the nonlinear slot need not be comprised of linear portions as in the above examples, but may instead be a curved slot having one or more radii of curvature. The average radius of curvature R may vary continuously along the length of the slot (FIG. 6) or may vary discontinuously (FIG. 7) thus defining one or more distinct junctures 32 between individual portions 26*a*, 26*b* of the slot. As seen in FIG. 8, a slot may comprise both curved and straight line portions in combination. Since the leak resistance of a slot depends on the abruptness and quantity of directional changes, a smoothly curved slot may provide unsatisfactory leak resistance. A curved slot with an abrupt directional change is expected to be superior to a smooth curve, but may be more difficult to manufacture than a slot comprised of straight line portions. One example of a curved slot having multiple, continuously varing radii of curvature is the serpentine slot of FIG. 5.

The slots need not be installed circumferentially between each and every airfoil, but may instead be installed selectively, for example between every second or third airfoil, to achieve the desired degree of thermal independence.

The cluster of FIG. 1 is one sector of a single array or stage of vanes. In some engines the vane clusters comprise two or more circumferentially aligned sub-clusters, integral with each other but axially separated from each other by an interstage space. In a fully assembled engine, rotor blades extend radially into the interstage space. The invention includes such multi-stage clusters as well as the illustrated single stage cluster.

Figure 9:
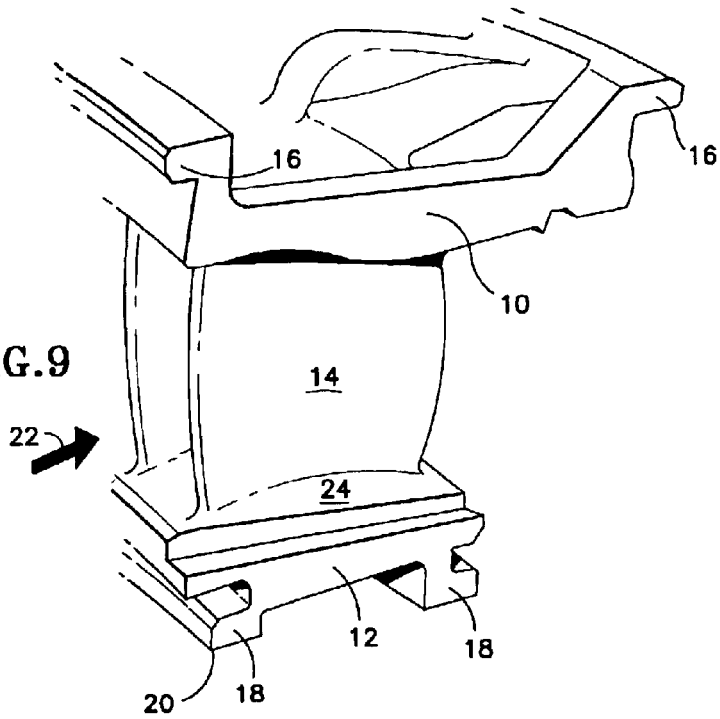
FIG. 9 is a view similar to FIG. 1 showing a vane cluster with a nonlinear profile at the lateral extremities of its inner shroud.

As seen in FIG. 9, the nonlinear geometry of the slot 26 may also be employed as the interface between the lateral extremities 20 of adjacent vane clusters. Such a construction includes inner and outer shrouds 10, 12 with at least one airfoil extending between the shrouds. The lateral extremities of at least one of the shrouds, e.g. inner shroud 12, has a nonlinear profile that matches a counterpart nonlinear profile on the extremity of a laterally adjacent vane cluster.

Although the invention has been presented in the context of stator vanes for a compressor, it is equally applicable to turbines. In addition, the invention includes clusters in which the outer shroud, rather than the inner shroud is the segmented shroud. It will be understood by those skilled in the art that these and other changes in form and detail may be made without departing from the invention as set forth in the accompanying claims.

I claim:

1. A vane cluster, comprising:

an outer shroud;

a radially inner shroud;

at least two airfoils extending between the shrouds;

one and only one of the shrouds having a slot residing between neighboring airfoils end extending nonlinearly from a radially inner surface of the shroud to a radially outer surface of the shroud to define shroud segments, the slot having a generally constant width.

2. The cluster of claim 1 wherein the nonlinear slot comprises at least two slot portions with a juncture therebetween, each juncture corresponding to a change of angular orientation.

3. The cluster of claim 2 comprising at least three slot portions with at least two changes of angular orientation.

4. The cluster of claim 3 wherein the changes of angular orientation define an accumulated angular change of at least about 180 degrees.

5. The cluster of claim 1 wherein the nonlinear slots comprises a curved portion.

6. The cluster of claim 1 wherein the nonlinear slot comprises at least two straight line segments.

7. The cluster of claim 1 wherein the shroud having a nonlinear slot extending therethrough is the inner shroud.

8. The cluster of claim 1 wherein a nonlinear slots is present between each and every neighboring airfoil of the cluster.

9. The cluster of claim 1 wherein the slot is formed by electro-discharge machining.

10. The cluster of claim 1 wherein the slot is defined by a kerf arising from material removal from an otherwise unitary shroud.

11. The cluster of claim 1 wherein the slot is formed by removing material from an otherwise unitary shroud.

12. The cluster of claim 1 wherein the shroud has a unitary prefinished state arid a severed finished state.

13. The cluster of claim 1 wherein the nonlinear slot is the exclusive means for resisting fluid leakage through the slot.

* * * * *